US009139956B1

(12) United States Patent
Hunt et al.

(10) Patent No.: US 9,139,956 B1
(45) Date of Patent: Sep. 22, 2015

(54) METHOD FOR ADJUSTING INLET FLOW TO A FLASH

(71) Applicant: Andritz Inc., Glens Falls, NY (US)

(72) Inventors: Tyson Bradford Hunt, Saratoga Springs, NY (US); Richard M. Grogan, Queensbury, NY (US); Keith Vogel, Queensbury, NY (US); Todd S. Grace, Alpharetta, GA (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 14/745,902

(22) Filed: Jun. 22, 2015

Related U.S. Application Data

(62) Division of application No. 13/747,976, filed on Jan. 23, 2013, now Pat. No. 9,103,070.

(60) Provisional application No. 61/598,112, filed on Feb. 13, 2012.

(51) Int. Cl.
*D21C 11/06* (2006.01)

(52) U.S. Cl.
CPC ..... *D21C 11/063* (2013.01)

(58) Field of Classification Search
CPC ..... D21C 7/10; D21C 7/14; D21C 11/00; D21C 7/12; D21C 11/0071; D21C 1/00; D21C 7/06; D21C 11/04; D21C 11/06; D21C 11/063; D21C 11/10; D21C 3/24; B01D 19/0036; B01D 3/06; F25B 2400/23; F25B 2400/13
See application file for complete search history.

(56) References Cited

U.S. PATENT DOCUMENTS

| | | | | | |
|---|---|---|---|---|---|
| 4,511,376 | A * | 4/1985 | Coury | 95/256 |
| 4,551,198 | A * | 11/1985 | Wiley | 159/47.3 |
| 6,103,058 | A * | 8/2000 | Engstrom | 162/19 |
| 6,171,494 | B1 * | 1/2001 | Snekkenes et al. | 210/405 |
| 6,346,166 | B1 * | 2/2002 | Kettunen et al. | 162/14 |
| 8,685,205 | B2 * | 4/2014 | Nellis et al. | 162/29 |
| 2001/0000588 | A1 * | 5/2001 | Snekkenes | 162/237 |
| 2009/0020480 | A1 * | 1/2009 | Hunt et al. | 210/709 |
| 2010/0224335 | A1 * | 9/2010 | Tikka | 162/47 |
| 2011/0139794 | A1 * | 6/2011 | Pham et al. | 220/565 |
| 2013/0206346 | A1 * | 8/2013 | Hunt et al. | 162/29 |
| 2014/0352900 | A1 * | 12/2014 | Grogan et al. | 162/29 |

FOREIGN PATENT DOCUMENTS

| | | | |
|---|---|---|---|
| EP | 2692944 | A1 * | 2/2014 |
| EP | 2626462 | B1 * | 10/2014 |
| JP | 2013227710 | A * | 11/2013 |
| WO | WO 9954515 | A1 * | 10/1999 |
| WO | WO 2009152570 | A1 * | 12/2009 |

* cited by examiner

*Primary Examiner* — Jose Fortuna
(74) *Attorney, Agent, or Firm* — Kerri Hochgesang; Robert Joseph Hornung

(57) ABSTRACT

A flash tank including: a closed interior chamber; a gas exhaust port coupled to an upper portion of the chamber; a liquid discharge port coupled to a lower portion of the chamber; an inlet nozzle attached to an inlet port of the chamber, wherein the inlet nozzle includes a flow passage, and a movable valve plate in the flow passage, wherein the valve plate has a first position which defines a first throat in the flow passage and a second position which defines a second throat having a smaller cross-sectional area than the first throat.

10 Claims, 4 Drawing Sheets

METHOD FOR ADJUSTING INLET FLOW TO A FLASH

CROSS RELATED APPLICATION

This application is a divisional application claiming the benefits of U.S. Non-provisional patent application Ser. No. 13/747,976 filed Jan. 23, 2013, now U.S. Pat. No. 9,103,070, the entirety of which is incorporated herein by reference; the Ser. No. 13/747,976 application in turn claims the benefit of U.S. Provisional Patent Application Ser. No. 61/598,112 filed Feb. 13, 2012, the entirety of which is incorporated herein by reference.

BACKGROUND OF THE INVENTION

The present invention relates to flashing fluids extracted from pressurized reactor vessels and particularly to flash tanks for flashing black liquor from a pressurized reactor vessel in a pulping or biomass treatment system.

Flash tanks are generally used to flash a high pressure fluid liquor stream including steam and condensate. A flash tank typically has a high pressure inlet port, an interior chamber, an upper steam or gas discharge port and a lower condensate or liquid discharge port. Flash tanks safely and efficiently reduce pressure in a pressurized fluid stream, allow recovery of heat energy from the stream, and collect chemicals from the stream in condensate.

Flash tanks may be used to recover chemicals from chemical pulping systems, such as Kraft cooking systems. Flash tanks are also used in other types of cooking systems for chemical and mechanical-chemical pulping systems. To pulp wood chips or other comminuted cellulosic fibrous organic material (collectively referred to herein as "cellulosic material"), the cellulosic material is mixed with liquors, e.g., water and cooking chemicals, and pumped in a pressurized treatment vessel. Sodium hydroxide, sodium sulfite and other alkali chemicals are used to "cook" the cellulosic material such as in a Kraft cooking process. These chemicals degrade lignins and other hemicellulose compounds in the cellulosic material. The Kraft cooking process is typically performed at temperatures in a range of 100 degrees Celsius (100° C.) to 170° C. and at pressures at or substantially greater than atmospheric.

The cooking (reactor) vessels may be batch or continuous flow vessels. The cooking vessels are generally vertically oriented and may be sufficiently large to process 1,000 tons or more of cellulosic material per day. The material continuously enters and leaves the vessel, and remains in the vessel for several hours. In addition to the cooking vessel, a conventional pulping system may include other reactor vessels (such as vessels operating at or near atmospheric pressure or pressurized above atmospheric pressure) such as for impregnating the cellulosic material with liquors prior to the cooking vessel. In view of the large amount cellulosic material in the impregnation and cooking vessels, a large volume of black liquor is typically extracted from these vessels.

The black liquor includes the cooking chemicals and organic chemicals or compounds, e.g., hydrolysate, residual alkali, lignin, hemicellulose and other dissolved organic substances, dissolved from the cellulosic materials. The black liquor is flashed in a flash tank to generate steam and condensate. The cooking chemicals and organic compounds are included with the liquid condensate formed when the liquor is flashed. The steam formed from flashing is generally free of the chemicals and organic compounds. The condensate is processed to, for example, recover and recausticize the cooking chemical. The steam may be used as heat energy in the pulping system.

In conventional flash tanks, the black liquor enters flash tanks through an inlet pipe having a fixed inlet diameter. The inlet is not variable or otherwise controllable to adjust the size of the black liquor flow passage. Changes to the flow passage at the inlet to a conventional flash tank for black liquor have been made by changing the inlet piping to the flash tank. Conventional flash tanks do not have a means for adjusting the flow passage; controlling of the volume or the velocity of the black liquor flow into the flash tank, pressure drop in the flash tank, or regulating the pressure in the conduits containing black liquor connected to the inlets to the flash tanks.

BRIEF DESCRIPTION OF THE INVENTION

An inlet for a flash tank has been conceived where the flow passage area of the inlet to the flash tank is varied to allow for control of the flow passage area of the inlet to the flash tank without changing of physical or mechanical components of the inlet or flash tank. The flow passage area is adjusted by a pivoting hinged plate in the inlet to the flash tank. This movable, hinged plate may be located at, near or after the junction between piping and the inlet to the flash tank. At this junction, the piping typically transitions from piping having a rectangular cross-section to piping circular in cross-section.

The movable, hinged plate changes of the cross-sectional area of the inlet to adjust the flow passage area through which hot black liquor flows from fully open to smaller area or from a smaller area to a larger area. This adjustment of the inlet opening size provides a means to control the velocity of the fluid into the tank.

The movable, hinged plate may be operated by a pneumatic or electro-mechanical actuator. A formable seal may be provided on either the movable hinged plate or the interior of the pipe to prevent leaking of hot black liquor out of the pipe or past the side edges of the plate.

A flash tank has been conceived including: a closed interior chamber; a gas exhaust port coupled to an upper portion of the chamber; a liquid discharge port coupled to a lower portion of the chamber; an inlet nozzle attached to an inlet port of the chamber, wherein the inlet nozzle includes a flow passage having a throat, and a movable valve plate in the flow passage, wherein the valve plate has a first position which defines a first throat area in the flow passage and a second position which defines a second throat area having a smaller cross-sectional area than the first throat area.

The valve plate may be a rectangular plate having planar surfaces bounded by edges and the flow passage may have a rectangular cross-section. The rectangular plate may be attached to a hinge attached to a sidewall of the flow passage. The hinge may be attached to an upstream end of the valve plate and creates a pivoting axis for the valve plate.

The valve plate may have an actuator connected to the valve plate, wherein the actuator moves the valve plate between the first and second positions.

The valve plate may be moved by an actuator having an extendible shaft connected to the valve plate, wherein the actuator moves the valve plate between the first and second positions.

A method has been conceived to flash a pressurized liquor comprising: feeding a pressurized liquor to an inlet nozzle of a flash tank; flashing the pressurized liquor as the liquor flows from the inlet nozzle into an interior chamber of the flash tank; exhausting a gas exhaust formed by the flashing through an upper portion of the chamber; discharging a liquid formed by the flashing from a lower portion of the chamber, and adjusting a cross-sectional area of a flow passage in the inlet nozzle by moving a valve plate in the flow passage.

The step of feeding may include a first feeding step in which the pressurized liquor flows through the flow passage while the valve plate is at a first position which defines a first throat area in the flow passage and a second feeding step in which the pressurized liquor flows through the flow passage while the valve plate is in a second position which defines a second throat area having a smaller cross-sectional area than the first throat area. Additional valve plate positions may also exist where the valve plate in multiple positions along the flow passage define multiple throats having smaller cross-sectional areas than the first throat area.

The method may include adjusting the cross-sectional area of the flow passage in the inlet nozzle allows for control of the volume of flow of black liquor entering the flash tank. Adjusting of the cross-sectional area of the flow passage inlet nozzle may also allow for control of the flow velocity of the black liquor entering the flash tank. Additionally, adjusting the cross-sectional area of the flow passage in the inlet nozzle allows for a degree of control over the pressure drop in the flash tank. Adjusting the cross-sectional area of the flow passage in the inlet nozzle may also ensure sufficient pressure in the conduits upstream of the inlet nozzle to the flash tank.

DETAILED DESCRIPTION OF THE INVENTION

Figure 1:
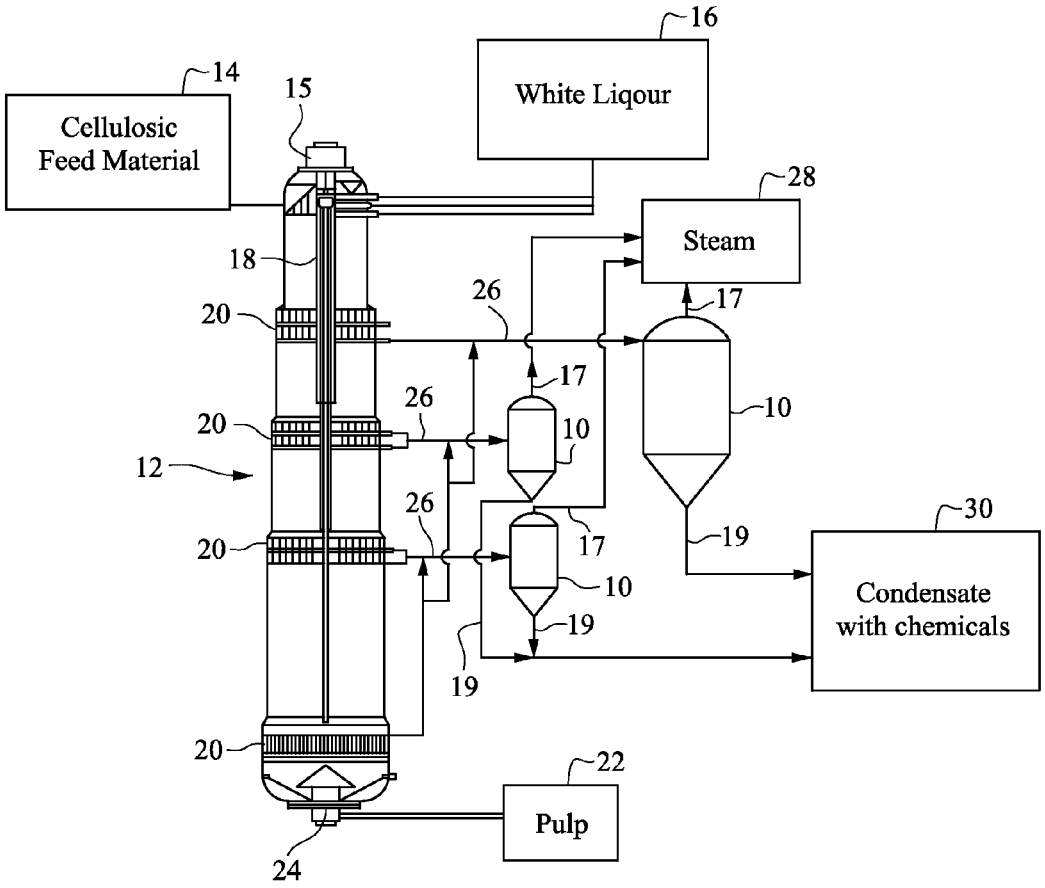
FIG. 1 (Prior Art)
FIG. 1 is a schematic diagram of a conventional flash tank receiving black liquor extracted from a pressurized reactor vessel.

FIG. 1 is a schematic diagram of a pulping system including a flash tank 10 coupled to a vessel 12, e.g., an impregnation vessel or a cooking vessel. A slurry of cellulosic material 14 and liquor flow to an upper inlet 15 of the vessel 12. White liquor 16 may be added to the vessel 12 such as through center inlet pipes 18. Screen assemblies 20 at various elevations in the vessel 12 extract black liquor from the cellulosic material moving down through the vessel 12. The material is discharged as pulp 22 from the bottom 24 of the vessel.

The black liquor extracted from the vessel 12 may flow to the flash tank 10 through conduits 26 fluidly coupling the screen assemblies 20 to a respective flash tank 10. The number of flash tanks 10 and whether one flash tank 10 receives black liquor from multiple screen assemblies 20 are design choices. The number, size and arrangement of flash tanks 10 may also depend on the design choice of whether to have heat exchange equipment in the conduits 26 leading to the flash tanks 10.

Black liquor flashes in the flash tank 10 to form steam 28 and condensate 30. The steam 28 flows out upper outlets 17 of the flash tanks 10. The condensate 30 flows as a liquid from bottom discharges 19 of the flash tanks 10.

Figure 2:
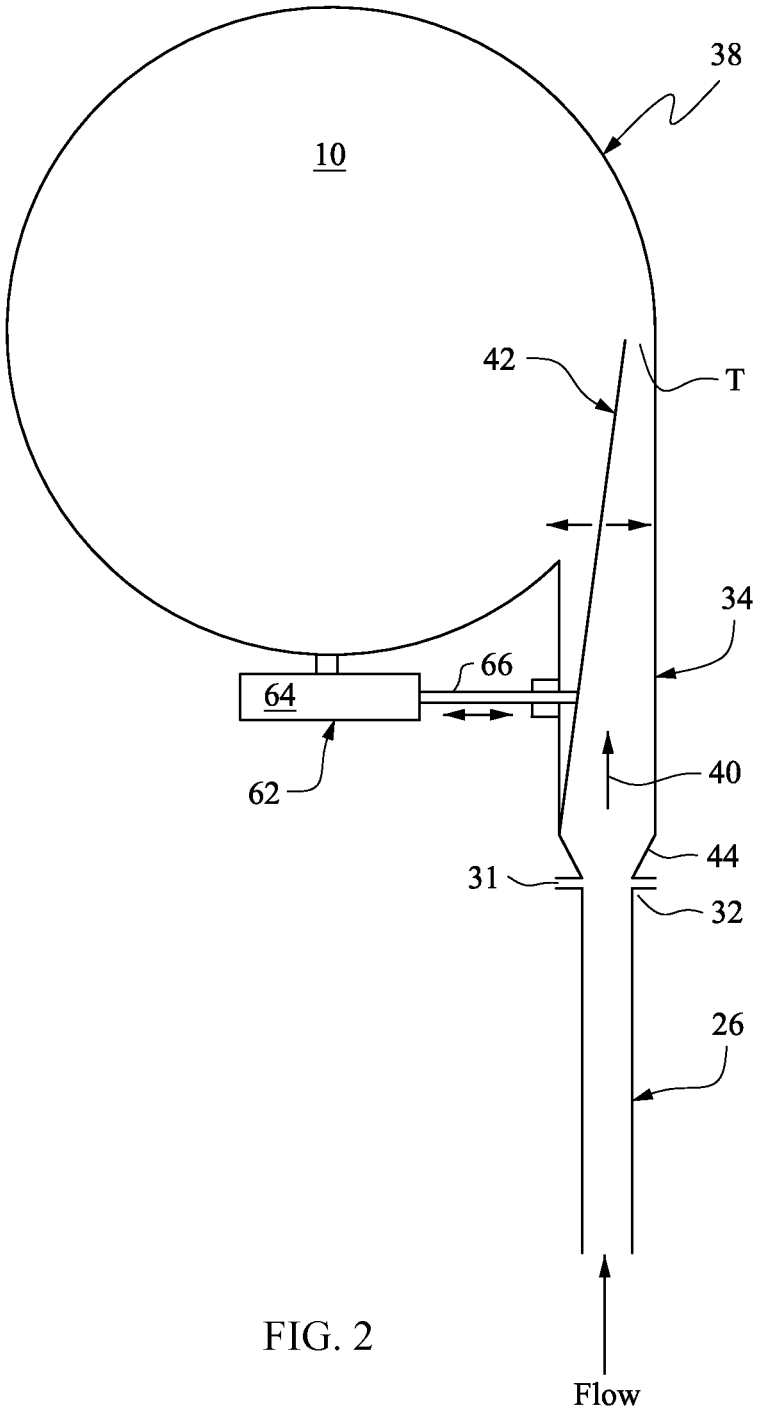
FIG. 2 is cross-sectional view of the flash tank taken along a horizontal line, wherein the inlet nozzle is attached to the tank along a tangent to tank.

FIG. 2 is a cross-sectional view of the flash tank 10, wherein the cross-section is along a horizontal plane bisecting the inlet piping system to the flash tank 10. The conduits 26 transporting the black liquor to be flashed may be cylindrical pipes. The inlet nozzle 34 to the flash tank 10 may be rectangular in cross-section. An end outlet 32 of the conduits 26 connects to the inlet nozzle 34 attached to the flash tank 10. The inlet nozzle 34 may be tangential to a cylindrical portion 38 of the flash tank 10.

The flash tank 10 need not be cylindrical and the inlet nozzle 34 need not be tangential to the flash tank 10. The flash tank 10 may have planar sections in its sidewall. Other suitable configurations of the inlet nozzle 34 may be oriented vertically and attached to the top of the flash tank 10 or to the side of the flash tank 10 without being tangential to the sidewall of the flash tank 10.

The flow passage 40 through inlet nozzle 34 may be rectangular, e.g., square, in cross-section. The rectangular cross section allows a valve plate 42 in the flow passage 40 to move, e.g., pivot, within the flow passage 40. The valve plate 42 regulates the velocity of the flow stream of black liquor to the flash tank 10.

A transition section 44 at the upstream end of the inlet nozzle 34 may convert a round inlet to a rectangular cross section of the remainder of the flow passage 40 through the inlet nozzle 34. The inlet of the transition section 44 connects to the end of the conduit 26. The outlet of the transition section 44 connects to the inlet nozzle 34. The transition section 44 may include a flange coupling 31 to attach to an end outlet 32 of the conduit 26.

Figure 3:
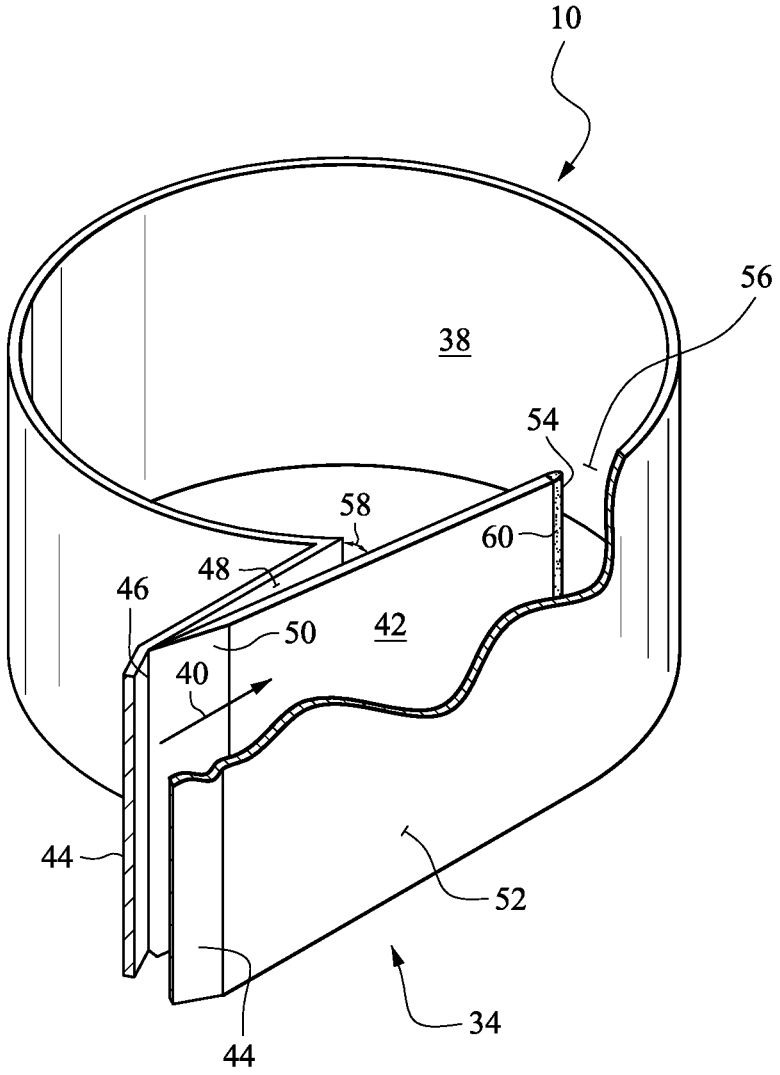
FIG. 3 shows a perspective and partially cut-away view of the inlet nozzle to illustrate the valve plate and the connection of the nozzle to the sidewall of the flash tank.

FIG. 3 illustrates an exemplary valve plate 42 in the inlet nozzle 34. The inlet nozzle 34 extends tangentially to the cylindrical portion 38 of the flash tank 10. The valve plate 42 may be attached to a hinge 46 fixed to a sidewall 48 of the flow passage 40 through the inlet nozzle 34. An upstream end 50 end of the valve plate 42 is fixed to the hinge 46 and may be adjacent the sidewall 48.

Pressurized black liquor flows through the flow passage 40 and, specifically, between the valve plate 42 and an opposite sidewall 52 of the inlet nozzle 34. The valve plate 42 may extend downstream such that the downstream edge 54 of the valve plate 42 is proximate to an opening 56 in the side of the cylindrical portion 38 of the flash tank 10.

The valve plate 42 pivots, see arrow 58, about the vertical axis of the hinge 46. The range of angles through which the valve plate 42 pivots is a design parameter to be selected during the design of the inlet nozzle 34. The range of angles may swing the valve plate 42 from being adjacent to the sidewall 48 (a zero angle position) to a maximum angle position where the downstream edge 54 abuts the end of the opposite sidewall 52.

The downstream edge 54 of the valve plate 42 will form an edge of the throat area (T in FIGS. 2 and 4) of the flow passage 40. The throat area T is the narrowest cross-sectional area of the flow passage 40. The throat area T is directly related to the capacity, quantity of black liquor the flow passage 40 is capable of passing to the flash tank 10. The throat area T of the flow passage 40 is widest and has a maximum capacity when the angle of the valve plate 42 is zero and the valve plate 42 is adjacent the sidewall 48. The throat area T of the flow passage 40 is narrowest and has a minimum capacity, which may be a zero flow rate, when the valve plate 42 is at a maximum angle the downstream edge 54 nearest the opposite sidewall 52 of the flash tank 10.

The downstream edge 54 of the valve plate 42 may have a replaceable or hardened strip 60, e.g., soft metal such as copper or a plastic material capable of withstanding the abrasive conditions such as those from the black liquor, which may be available to act as a seal between the downstream edge 54 of the valve plate 42 and the opposite sidewall 52 or interior wall of the flash tank 10. A similar strip 60 may be along the upper and lower side edges of the valve plate 42.

Figure 4:
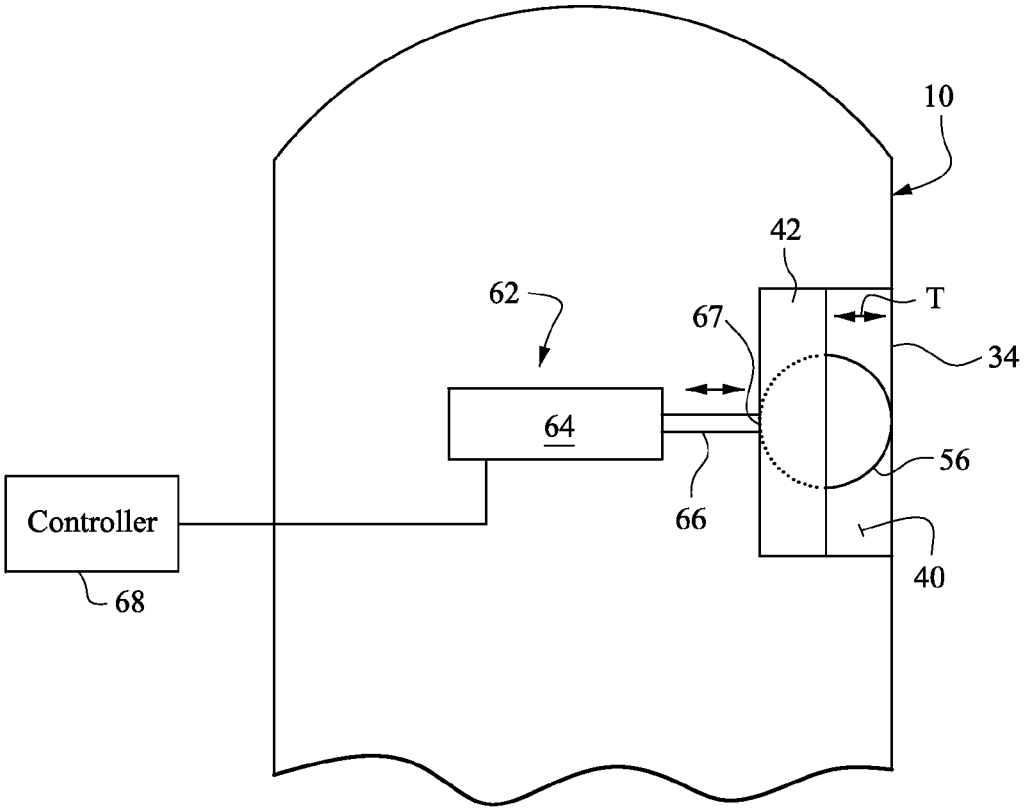
FIG. 4 is a cross-sectional schematic view of the inlet nozzle taken along a vertical plane to illustrate the valve plate.

FIG. 4 is a cross-sectional schematic diagram of the inlet nozzle 34 taken along a vertical plane and showing a side of the flash tank 10. FIG. 4 shows a view looking directly into the inlet nozzle 34 in a downstream direction of the flow passage 40. The rectangular cross-sectional shape of the flow passage 40 is evident as is the oval or circular shape of the opening 56 to the flash tank 10. The valve plate 42 is shown extending partially across the flow passage 40 and forming a rectangular throat area (T). The valve plate also extends across and blocks a portion of the opening 56 to the flash tank 10.

The area of the flow passage 40 and portion of the opening 56 blocked or closed off by the valve plate 42 depends on the position of the valve plate 42 and particularly on the position of the downstream edge 54 (see FIG. 3) of the valve plate 42. The valve plate 42 may extend completely across the flow passage 40 and cover the entire flow passage 40, from top to bottom and side to side. On the other hand, the valve plate 42 may be positioned to be parallel and adjacent the sidewall 48 and thereby open the flow passage 40 and opening 56.

The motion of the movable, hinged valve plate 42 is controlled by a pneumatic or electro-mechanical actuator 62, such as a pneumatic piston pump. The actuator 62 may have a cylindrical body 64 attached to the side of the flash tank 10 and a reciprocating shaft 66 driven by a piston in the cylindrical body 64. A distal end of the shaft 66 is pivotable and is attached to the backside of the valve plate 42. The actuator 62 may extend and retract the shaft 66 to move the valve plate 42 to open the throat area T or close the throat area T of the flow passage 40. The shaft 66 extends through a port 67 in the sidewall 48 of the inlet nozzle 34. The port 67 may include a seal to prevent leakage of black liquor.

A controller 68, e.g., a computer or manual adjustment, determines the extension of the shaft 66 and the position of the valve plate 42. The controller 68 may extend the shaft 66 to set the position of the valve plate 42 and achieve a desired throat area T for the flow passage 40. The controller 68 may be adjusted manually to change or adjust the position of the valve plate 42. Alternatively, the controller 68 may adjust the position of the valve plate 42 by computer, manual adjustment or other suitable means based on, for example, comparison between a desired pressure in the flow passage 40 and a sensed pressure in the flow passage 40.

Hot black liquor extracted from the screens 20 of a vessel 12 flows through the inlet nozzle 34 and enters the flash tank 10. The throat area T of the inlet nozzle 34 determines volume of flow or flow velocity using backpressure in the flow passage 40 which restricts the flow of black liquor entering the flash tank 10. Because the throat area T is determined by the position of the valve plate 42, the controller 68 can move the valve plate 42 to adjust the throat area T and consequently the velocity or volume of flow through the flow passage 40.

Controlling the volume of flow or flow velocity in the inlet nozzle 34 allows for the velocity and volume of black liquor entering the flash tank 10 to be regulated, provides a degree of control over the pressure drop in the flash tank 10 and ensures a sufficient pressure in the conduits 26 upstream of the inlet nozzle 34.

As the black liquor enters the flash tank 10, the liquor flashes to produce steam 28 and condensate 30. The steam 28 may be used as heat energy in the vessel 12, in an impregnation vessel (not shown), in a chip feed bin (not shown), in a chip steaming vessel (not shown), in a tank holding fresh cooking liquor, e.g., white liquor, or other locations in the mill where steam is needed. The condensate 30 may flow to additional flash tanks 10 or other chemical recovery equipment (not shown), e.g., a recovery boiler, an evaporation system or other chemical recovery system.

The orientation of the valve plate 42 in the inlet nozzle 34 is a design choice. The hinge 66 for the valve plate 42 may be attached to either sidewall 48 or the top or bottom walls of the flash tank 10.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to flash a pressurized liquor comprising:

feeding a pressurized liquor to an inlet nozzle of a flash tank;

flashing the pressurized liquor as the liquor flows from the inlet nozzle into an interior chamber of the flash tank;

exhausting a gas exhaust formed by the flashing through an upper portion of the chamber;

discharging a liquid formed by the flashing from a lower portion of the chamber, and adjusting a cross-sectional throat area of a flow passage in the inlet nozzle by moving a valve plate in the flow passage.

2. The method of claim 1 wherein the step of feeding includes a first feeding step in which the pressurized liquor flows through the flow passage while the valve plate is at a first position which defines a first throat area in the flow passage and a second feeding step in which the pressurized liquor flows through the flow passage while the valve plate is in a second position which defines a second throat area having a smaller cross-sectional area than the first throat area.

3. The method of claim 1 wherein the step of feeding includes a first feeding step in which the pressurized liquor flows through the flow passage while the valve plate is at a first position which defines at least a first throat area in the flow passage and a second feeding step in which the pressurized liquor flows through the flow passage while the valve plate is in multiple positions which define multiple throats having smaller cross-sectional area than the first throat area.

4. The method of claim 1 wherein the gas exhaust formed is steam.

5. The method of claim 1 wherein the liquid formed is condensate.

6. The method of claim 1 wherein the pressurized liquor fed to the inlet nozzle of the flash tank is black liquor.

7. The method of claim 1 wherein the adjusting the cross-sectional area of a flow passage in the inlet nozzle allows for control of the volume of flow of black liquor entering the flash tank.

8. The method of claim 1 wherein adjusting the cross-sectional area of the flow passage in the inlet nozzle allows for control of the flow velocity of the black liquor entering the flash tank.

9. The method of claim 1 wherein adjusting the cross-sectional area of the flow passage in the inlet nozzle allows for a degree of control over the pressure drop in the flash tank.

10. The method of claim 1 wherein adjusting the cross-sectional area of the flow passage in the inlet nozzle ensures a sufficient pressure in the conduits upstream of the inlet nozzle to the flash tank.

* * * * *